United States Patent [19]

Takabayashi

[11] 4,126,073

[45] Nov. 21, 1978

[54] ELECTRIC GUITAR

[75] Inventor: Youjiro Takabayashi, Hamamatsu, Japan

[73] Assignee: Nippon Gakki Seizo Kabushiki Kaisha, Japan

[21] Appl. No.: 702,424

[22] Filed: Jul. 6, 1976

[30] Foreign Application Priority Data

Jul. 18, 1975 [JP] Japan ..... 50-99070[U]
Jul. 18, 1975 [JP] Japan ..... 50-99071[U]

[51] Int. Cl.[2] ..... G10D 3/00; G10D 1/08

[52] U.S. Cl. ..... 84/293; 84/291; 84/267

[58] Field of Search ..... 84/293, 267, 290, 291

[56] References Cited

U.S. PATENT DOCUMENTS

| | | | |
|---|---|---|---|
| 600,507 | 3/1898 | Bremerman | 84/293 |
| 3,072,007 | 1/1963 | Burke | 84/267 |
| 3,396,621 | 8/1968 | Dycus | 84/293 |
| 3,426,638 | 2/1969 | Smith | 84/293 |
| 3,439,570 | 4/1969 | Lee | 84/293 |
| 3,443,018 | 5/1969 | Krebs | 84/293 |
| 3,538,807 | 11/1970 | Francis | 84/293 |
| 3,657,462 | 4/1972 | Robinson | 84/293 |
| 3,696,700 | 10/1972 | Berardi | 84/293 |
| 3,915,049 | 10/1975 | Bean | 84/293 |
| 3,943,816 | 3/1976 | Goursau | 84/293 |

*Primary Examiner*—Stephen J. Tomsky
*Attorney, Agent, or Firm*—Ostrolenk, Faber, Gerb & Soffen

[57] ABSTRACT

An electric guitar has a neck of a unitary elongated construction which is coupled to and extends through the body at least up to a location where a bridge and a tail piece are provided, and at least one member of a relatively hard wooden or light metallic material interconnecting the base portion of the neck to the body, whereby the acoustic characteristics of the guitar are greatly improved.

7 Claims, 5 Drawing Figures

ELECTRIC GUITAR

BACKGROUND OF THE INVENTION

The present invention relates to an electric guitar, and more particularly relates to an improved coupling construction of a neck with a body of an electric guitar.

In conventional electric guitars, a neck for carrying a head on one end thereof is joined to a body at the other end and strings are stretched between the head and a tail piece provided on the body running over a bridge element also provided on the body. In order that the above-described end junction can satisfactorily bear the large stress caused by the stretched strings, it is necessary to provide the end junction and its related part with a reinforcing construction such as a swell formed on the underside of the end junction. Presence of such a reinforcing construction at the end junction hinders easy access of player's fingers upon the strings in the area of the end junction. Without such a reinforcing construction, the end junction can hardly bear the large stress imposed by the strings.

Further, the acoustical characteristics of the electric guitar are believed to be more or less degraded due to the very constructional feature that the neck holding one end of the strings via the head and the body holding the other ends of the strings via the tail piece and the bridge element are of separate bodies and are joined to each other at the end of the neck.

After a long term study on the relationship between the constructional feature and acoustic characteristics of electric guitars, it was confirmed by the inventor of the present invention that the acoustical characteristics of a guitar are greatly influenced by the mode of the junction between the neck and the body. In other words, it has been found that the junction mode is a very important key factor for obtaining excellent acoustic characteristics. Upon vibration of the strings, the vibration is transmitted via the bridge and tail piece to the body and further to the neck, and the vibrations of these elements are collected by the pickup.

In the case of the conventional guitar in which the neck and body are formed as separate elements and joined to each other at one end of the neck, the vibration of the strings received by the body cannot be sufficiently transmitted to the neck, thereby degrading the sound quality of the electric guitar.

On the basis of this knowledge, the inventor of the present invention proposes to eliminate the end junction between the neck and the body in the construction of the electric guitar.

BRIEF DESCRIPTION OF THE INVENTION

Thus, in accordance with the present invention, the electric guitar has a neck of a unitary elongated construction provided with a base extending through the body and having its sides coupled to the latter. On both sides of the neck base, side elements made of a relatively hard wooden or light metallic material intervene between the neck base and the body. The body may be either in the form of a pair of body halves sandwiching the neck base or in the form of a construction having an elongated groove adapted to receive the neck base.

BRIEF DESCRIPTION OF THE FIGURES

Further features and advantages of the present invention will be made clearer from the following description, reference being made to the embodiments shown in the accompanying drawings, in which.

DETAILED DESCRIPTION OF THE INVENTION

Figure 1:
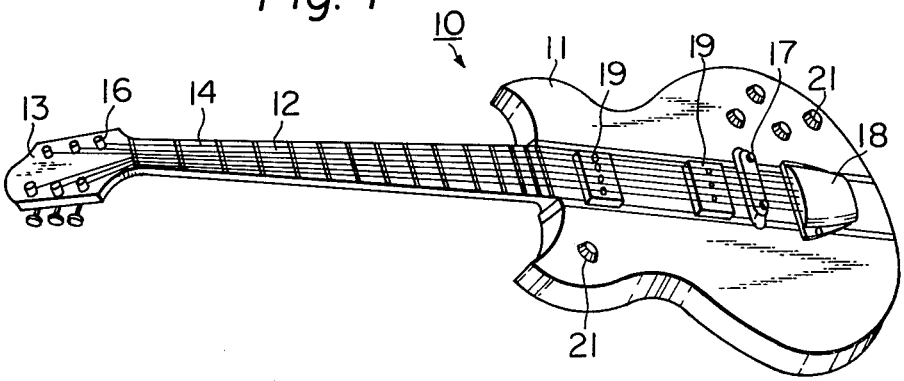
FIG. 1 is a perspective plan view of an embodiment of the electric guitar in accordance with the present invention.
Figure 2:
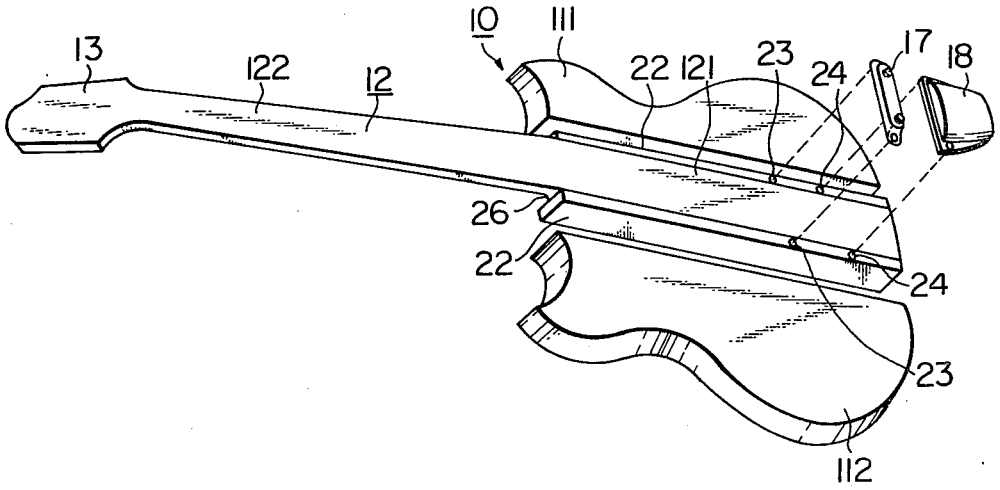
FIG. 2 is a simplified explanatory perspective view of the electric guitar shown in FIG. 1 in a disassembled and exploded disposition.

An embodiment of the electric guitar in accordance with the present invention is shown in FIGS. 1 and 2, in which the guitar 10 includes a body 11, a neck 12 disposed in the manner shown relative to the body 11 and a head 13 formed at the free end of the nect 12. A plurality of strings 14 are stretched over the neck 12 and a portion of the body 11 and are in substantially parallel relationship relative to each other. More specifically, the strings 14 are stretched between peg screws 16 provided on the head 13 and a tail piece 18 mounted on the side board 22 hereinafter described. A bridge element 11 is fixed to the side boards 22 adjacent to the tail piece 18 and bears the tension of the strings. Conventional electromagnetic pickups 19 and electric controls 21 are also provided on the body 11. The above-described construction is common to those of conventional electric guitars.

The specified construction in accordance with the present invention will be better understood from the illustration given in FIG. 2. In the construction shown in FIG. 2, the body 11 is made up of a pair of body halves 111 and 112, Whereas the neck 12 is made up of a base portion 121 to be coupled with the body halves 111 and 112 and of an extension 122 made integrally in one piece with the base 121 and connected, at the free end thereof, to the head 13.

The neck 12 and body 11 are made of a relatively soft wooden material such as mahogany, ash, katsura tree and nato tree.

In the area to be coupled with the body halves 111 and 112, the base portion 121 of the neck 12 is provided with a pair of side boards 22 bonded by conventional means such as adhesive to the side surfaces thereof. The side boards 22 are made of a material harder than that used for the body 11 and neck 12. Preferably, they are made of a relatively hard wooden material such as maple, ebony, birch or boxwood. Some light metals such as aluminum can be also used for the side boards 22.

The body halves 111 and 112 and the base 121 of the neck 12 are coupled to each other bonded by conventional means such as adhesive while sandwiching the side boards 22 in between. Threaded holes 23 and 24 are provided in the upper surfaces of the side boards 22 in order to fix the bridge element 17 and the tail piece 18 via suitable set screws (not shown) as shown with dotted lines in the drawing.

Figure 4:
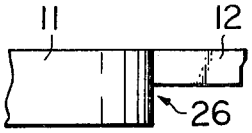
FIG. 4 is a fragmentary side plan view of the electric guitar in accordance with the present invention wherein the underside of the neck is scooped in the vicinity of the body.

As shown in FIG. 4, the underside portion 26 of the neck 12 at the border between the extension 122 and thebase 121 is regular and requires no reinforcing extension as in the prior art.

In the illustrated construction, the side boards 22 cover almost the entire length of the base 121 of the neck 12. That is, the side boards 22 cover the entire portion of the neck 12 connected to the body halves 111 and 112. However, it is satisfactory if the side boards 22 extend from the section of the body beyond which neck extension 122 extends back to the position at which bridge elements 17 and tailpiece 18 are fixed to the side boards 22.

Thus, in accordance with the present invention, the neck 12 extends through the body 12 and is in the form of an integral one-piece body. In addition, the neck 12 is accompanied with a pair of hard side boards 22 in the area to be coupled to the body 12, i.e. the body halves 111 and 112.

Figure 3:
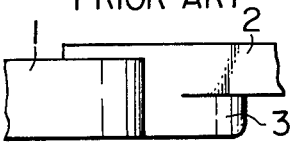
Fig. 3 PRIOR ART
FIG. 3 is a fragmentary side plan view of the conventional electric guitar wherein the end junction of the neck to the body is provided with a swell.

As already described, the guitar in accordance with the present invention is provided, as shown in FIG. 4, with the recess 26 on the underside of the border between the base 121 and the extension 122 whereas the conventional guitar is provided with a swell 3 on the underside of the junction of the body 1 with the neck 2 in order to fortify the junction as shown in FIG. 3.

Figure 5:
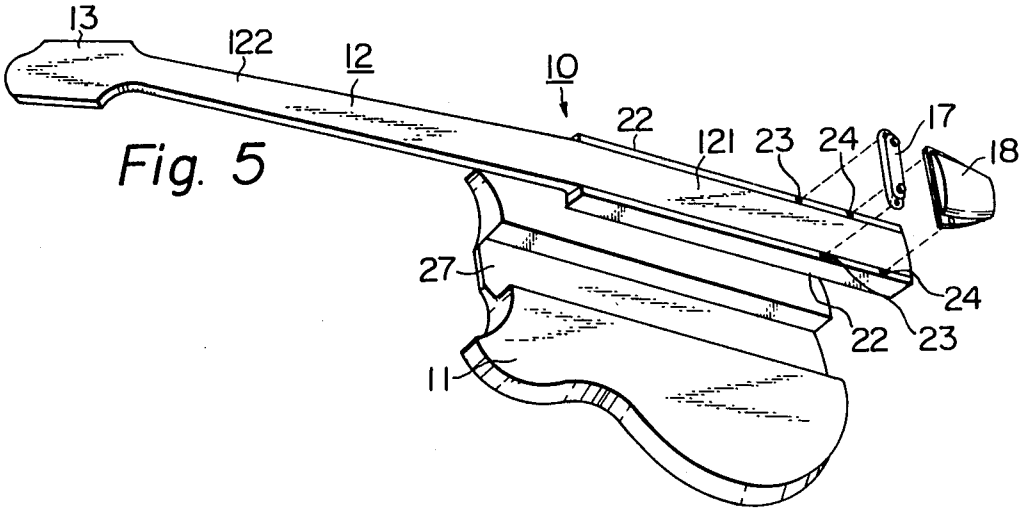
FIG. 5 is a simplified explanatory perspective plan view of another embodiment of the electric guitar in accordance with the present invention.

Another embodiment of the electric guitar in accordance with the present invention is shown in FIG. 5, in which the construction of the neck 12 is similar to the one shown in FIGS. 1 and 2. However, in the case of this embodiment, the body 1 is of a unitary construction having a longitudinal groove 27 adapted to receive the base portion 121 and the side boards 22 of the neck 12. The bridge element 17 and the tail piece 18 are fixed to the neck 12 in a manner similar to that shown in the embodiment of FIGS. 1 and 2. Thus, in the combined disposition, the neck 12 is suitably bonded into the groove 27 of the body 12 via the side boards 22.

The unitary elongated construction of the neck in accordance with the present invention eliminates the conventional junction between the end of the neck and the adjacent part of the body while very admirably bearing the heavy stress applied by the keenly stretched strings. In addition, as the neck is coupled to the body along the entire length of its base via the side boards, the junction between the neck and the body is by far more stable and stronger than that of the conventional electric guitars in which the neck is joined to the body at the end of thereof only. Thus, in the case of the electric guitar in accordance with the present invention, it is completely unnecessary, quite unlike the conventional electric guitars, to provide any special reinforcing construction at the junction between the neck and the body. Specifically, the longitudinal groove in the body of the embodiment shown in FIG. 5 provides a strong junction of the neck with the body as the former is fully accommodated in and fixed to the groove in the body.

Absence of the swell, which is conventionally formed at the end junction of the neck and the body, on the guitar in accordance with the present invention, enlarges the operational ambit of the player's fingers on the strings to the very vicinity of the body. In other words, the deep recess 26 enables easy access of the player's fingers on the strings to the very border between the extension and the base of the neck.

In addition to the above described advantages, it is very important to note that the present invention considerably improves the acoustic characteristics of the electric guitar.

In accordance with the present invention, the neck of the electric guitar assumes the form of a unitary body extended through the body of the guitar and accompanied with the hard side boards to the upper edges of to which the bridge element and the tail piece are fixed. In general, transmission of vibration through a hard body is far better than that through a soft body. Thus, the sonic vibration generated by the strings is efficiently transmitted to the neck base via the bridge element, the tail piece and the edges of the hard side boards, and further to the extension of the neck quite smoothly as the extension is made integral in one piece with the base. Thus, the electric guitar in accordance with the present invention can produce "fat" or "bite" sounds with considerably long sustained vibration of the sounds.

What is claimed is:

1. An electric guitar comprising a main resonating body; a neck having an elongated longitudinal base section inset within at least the upper boundary of said body and extending from one end of said body to the other end of said body; said neck having an extension unitary with said base member extending beyond said other end of said body for carrying a head at one end thereof;

a bridge and a tail piece;

at least one interconnecting member extending along the said base section of said neck and interconnecting said base of said neck to said body; said member being made of a material harder than that of said body;

and the edge thereof being substantially coplanar with the portion of the upper boundary adjacent thereof; a mounting for each of said bridge and tail piece; said bridge and tail piece being secured by said mounting to said edge of said interconnecting member.

2. An electric guitar as in claim 1 in which said base section of said neck portion is provided with a pair of interconnecting members, one on each opposite side of said base section and engaging said base section and said body; said interconnecting members comprising a pair of side boards; said bridge and tail piece each being secured to the said edges of said interconnecting members.

3. An electric guitar as claimed in claim 2 in which said body is made of a pair of body halves coupled to opposite sides of said neck base section, each cooperating with said neck for sandwiching one of said side boards therebetween.

4. An electric guitar as claimed in claim 2 in which said body is provided with a longitudinal groove for snugly receiving said neck base section and said side boards.

5. An electric guitar as in claim 1 in which said interconnecting member is made of a wood which is relatively harder than the wood of said body.

6. An electric guitar as in claim 1 in which said interconnecting member is made of a light metal such as aluminum.

7. An electric guitar as in claim 1 wherein the underside of the area of the neck between the extension and the body is substantially coterminous with the body.

* * * * *